US010251503B1

(12) United States Patent
Fulps

(10) Patent No.: US 10,251,503 B1
(45) Date of Patent: Apr. 9, 2019

(54) SECURE DELIVERY/DROP BOX FOR PARCELS AND PRODUCTS

(71) Applicant: Michael Fulps, Highlands Ranch, CO (US)

(72) Inventor: Michael Fulps, Highlands Ranch, CO (US)

( * ) Notice: Subject to any disclaimer, the term of this patent is extended or adjusted under 35 U.S.C. 154(b) by 0 days.

(21) Appl. No.: 16/103,804

(22) Filed: Aug. 14, 2018

Related U.S. Application Data

(60) Provisional application No. 62/544,967, filed on Aug. 14, 2017.

(51) Int. Cl.
*A47G 29/124* (2006.01)
*A47G 29/12* (2006.01)
*A47G 29/22* (2006.01)

(52) U.S. Cl.
CPC ..... *A47G 29/12* (2013.01); *A47G 29/1251* (2017.08); *A47G 29/22* (2013.01)

(58) Field of Classification Search
CPC .. A47G 29/12; A47G 29/1209; A47G 29/124; A47G 29/1248; A47G 29/1251; A47G 29/20; A47G 29/22; A47G 2029/148
USPC ..... 232/17, 19, 45, 47, 49–51, 38
See application file for complete search history.

(56) References Cited

U.S. PATENT DOCUMENTS 384,154 A * 6/1888 Harrigan ..... A47G 29/1209 232/49
890,766 A * 6/1908 Hann ..... A47G 29/16 232/24
1,147,953 A * 7/1915 Krycza ..... A47G 29/1209 232/49
1,155,146 A * 9/1915 Graves ..... A47G 29/1209 232/49
1,237,199 A * 8/1917 Graves ..... A47G 29/1209 232/49
7,428,980 B2 * 9/2008 Irwin ..... E05G 7/001 232/45
8,573,473 B1 * 11/2013 Farentinos ..... A47G 29/22 232/45
2018/0303265 A1 * 10/2018 Hearne ..... A47G 29/22

* cited by examiner

*Primary Examiner* — William L Miller
(74) *Attorney, Agent, or Firm* — Shifrin Patent Law; Dan Shifrin

(57) ABSTRACT

A delivery/drop box is provided for parcels and products ("items"). The box comprises: a frame; a plurality of wall, floor, fixed roof, and fixed front panels securable to the frame; a cam roof section hingeably securable to at least one of the frame and the fixed roof section; a drop door assembly hingeably securable to at least one of the frame and the fixed front panel. As the drop door assembly is moved to an open position, the cam roof section moves to a raised position and an opening into an interior of the box is created. The box further comprises a lockable door panel hingeably securable to one of the side or rear panels, whereby an item passed through the opening into the interior of the box is accessible when the door panel is unlocked and open and is inaccessible when the door panel is closed and locked.

12 Claims, 8 Drawing Sheets

SECURE DELIVERY/DROP BOX FOR PARCELS AND PRODUCTS

RELATED APPLICATION DATA

The present application is related to commonly-owned U.S. Application Ser. No. 62/544,967 entitled SECURE DELIVERY/DROP BOX FOR PARCELS, filed on Aug. 14, 2017, which application is incorporated herein by reference in its entirety.

TECHNICAL FIELD

The present invention relates generally to parcel delivery boxes and, in particular, to a secure delivery/drop box for parcels and products.

BACKGROUND ART

E-commerce spending continues to increase at a staggering rate, with web originated sales accounting for close to 12% of total retail spending. In 2016, UPS reported delivering an average of 19 million packages/documents globally every day. The convenience of point-and-click shopping with products delivered directly to one's door has been overwhelmingly embraced except for one drawback: security. The "last mile" historically has been a challenge for supply chain service providers and is now compounded by an ever-increasing volume. The security challenge resides in so many packages/products sitting on residential porches exposed to theft and weather before they can be brought inside. The exposure may be as little as a few minutes or as long as much of a day, such as if the recipient is at work. The exposure may even last several days, such as if the recipient is out of town. The risk of theft of packages off of front porches is even greater during the holiday season.

While some commercial-grade boxes exist in which packages may be securely placed, they are typically made of metal, are heavy, are costly and therefore targeted for business, not residential, use.

SUMMARY OF THE INVENTION

Embodiments of the present invention provide a delivery/drop box for parcels and products ("items"). The box comprises: a frame; a plurality of wall panels securable to the frame; a floor panel securable to the frame; a fixed roof section securable to the frame; a cam roof section hingeably securable to at least one of the frame and the fixed roof section; a fixed front panel securable to the frame; a drop door assembly hingeably securable to at least one of the frame and the fixed front panel. As the drop door assembly is moved to an open position, the cam roof section moves to a raised position and an opening into an interior of the box is created. The box further comprises a lockable door panel hingeably securable to one of the side or rear panels, whereby an item passed through the opening into the interior of the box is accessible when the door panel is unlocked and open and is inaccessible when the door panel is closed and locked.

DETAILED DESCRIPTION OF THE PREFERRED EMBODIMENT

The described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention can be practiced without one or more of the specific details, or with other methods, components and so forth. In other instances, well-known structures, materials, or operations are not shown or described in detail to avoid obscuring aspects of the invention.

Embodiments of the present invention provide a secure delivery/drop box for parcels and products that may be configured in a vertical or horizontal orientation. The delivery/drop box may be sold preassembled or as an easily-assembled, field-configurable, snap-together kit. The delivery/drop box may be located on the purchaser's porch or other convenient location and, to prevent theft of the delivery/drop box itself, secured to a post, pillar, railing, or even bolted into concrete. The delivery/drop box may be provided in any of a number of sizes and can, therefore, accommodate parcels and packages of various types and sizes. These may include, without limitation, boxes, food and grocery packages, prescriptions, documents, bankers boxes, beverages, and long items such as golf clubs.

Figure 1A:
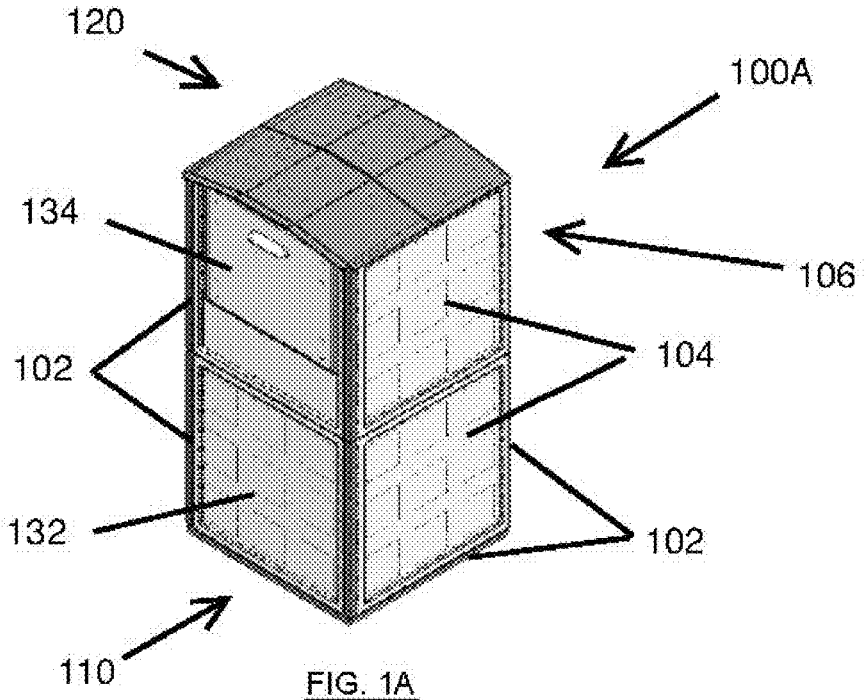
FIG. 1A illustrates an embodiment of the secure delivery/drop box of the present invention in the vertical configuration with the drop door closed.
Figure 1B:
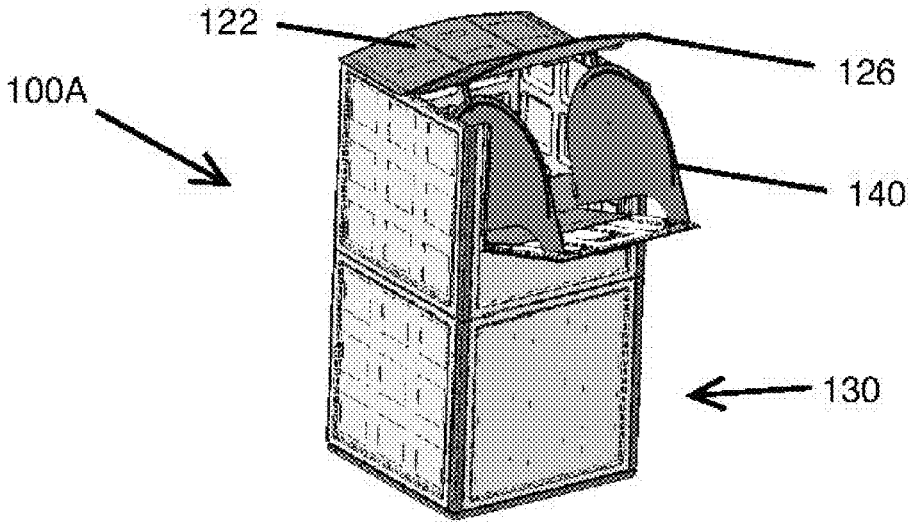
FIG. 1B illustrates the secure delivery/drop box of FIG. 1A with the drop door open.
Figure 2A:
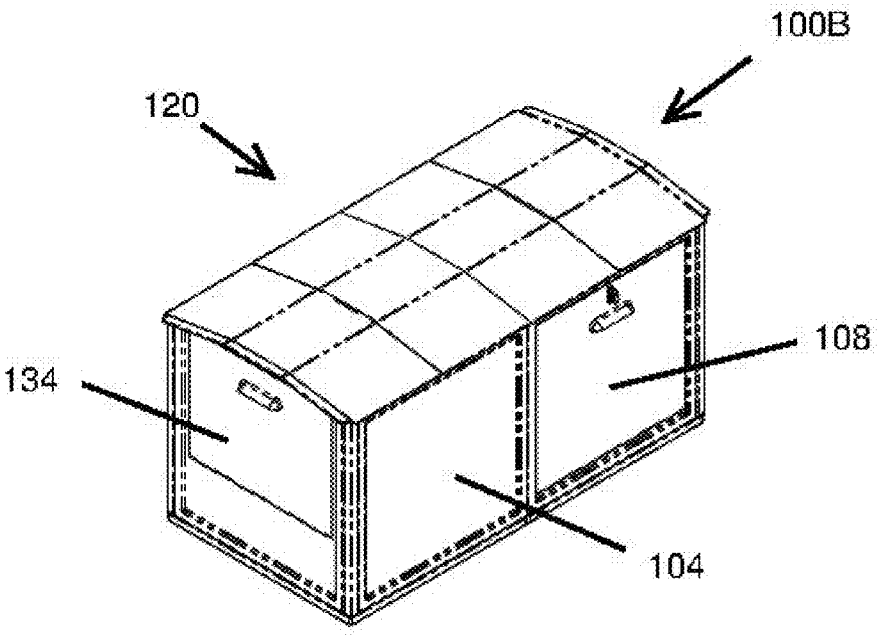
FIG. 2A illustrates an embodiment of the secure delivery/drop box of the present invention in the horizontal configuration with the drop door closed.
Figure 2B:
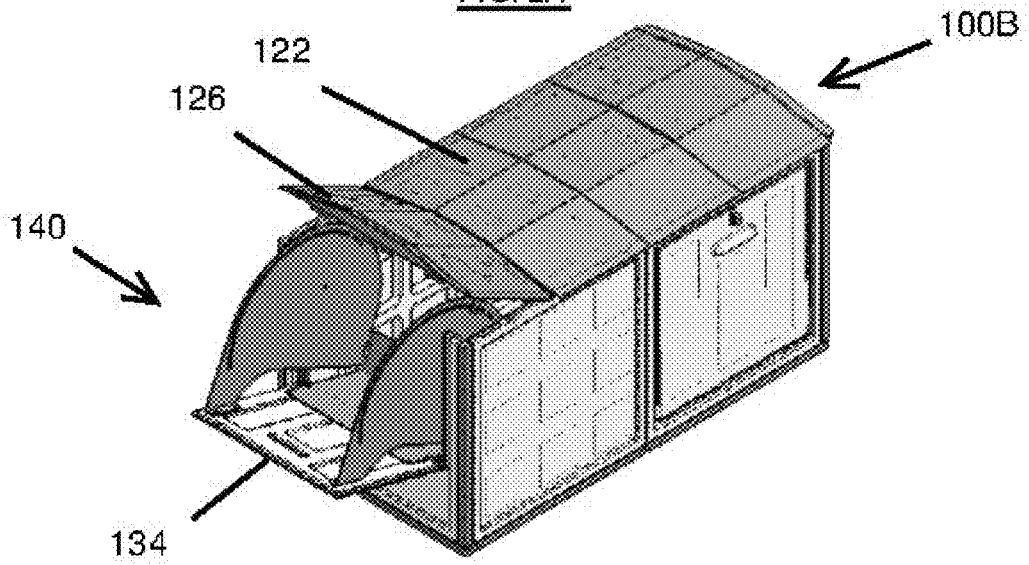
FIG. 2B illustrates the secure delivery/drop box of FIG. 2A with the drop door open.

FIGS. 1A and 1B illustrate the delivery/drop box 100A in the vertical configuration and FIGS. 2A and 2B illustrate the delivery/drop box 100B in the horizontal configuration. The delivery/drop box will be generally referred to by element number 100, whether in the vertical or horizontal configuration. Further, while the delivery/drop box 100 and its operation will be described with respect to the vertical configuration, the components and operation of the horizontal configuration are similar. FIG. 1A illustrates the delivery/drop box 100 prior to a parcel being delivered. The delivery/drop box 100 includes a frame 102, a set of side panels 104 and rear panels 106 joined to the frame 102 with connector pieces and forming walls of the box 100, one or more floor panels 110, and a roof 120, comprising a fixed section 122 and a hinged cam section 126, joined to the frame 102, the fixed section 122, or both. The front 130 of the delivery/drop box 100 includes a fixed front panel 132 and a front panel 134. Package delivery is made through a drop door assembly 140, to which the front panel 134 is secured. The drop door assembly 140 is joined to the frame 102, the fixed section 122, or both. Package retrieval is made through a lockable access door panel 108 (FIG. 2A). Because of the flexible design, the access panel 108 may be located on any side or the rear. As used herein, the term "front" refers to the side of the box 100 on which the drop door assembly 140 is located and "rear" refers to the side of the box 100 opposite the side on which the drop door assembly 140 is located. However, the fixed front panel 132, the rear panel(s) 106, and the side panels 104 may be interchangeable, thus enhancing the flexibility of the box 100.

To deliver a parcel, the deliverer opens the door 134 of the drop door assembly 140. If the parcel is small enough, the deliverer only needs to open the door 134 enough to place the parcel in the opening and let it slide into the interior of the delivery/drop box 100. If the parcel is larger, the deliverer opens the door 134 further. As the door 134 is opened, the cam section 126 of the roof 120 automatically rises, providing a larger opening for the parcel (FIG. 1B). After the parcel is slid into the interior, the door 134 may be closed, lowering the hinged section 126 of the roof at the same time, and the parcel drops into the interior of the box 100. With the parcel in the interior of the box 100, it is secure from theft until the recipient unlocks the access door 108 to retrieve the parcel.

The delivery/drop box 100 in the vertical configuration may include six fixed side/rear/front panels 104, 106, 132, and two floor panels 110 that are assembled to the frame 102. The hinged front panel 134 and drop door assembly 140 are assembled to the frame 102 in the front of the box 100A above a fixed front panel 132. The lockable retrieval door 108 may be assembled to the frame 102 below the rear panel 106 or in the rear. One fixed roof panel 122 and the hinged roof panel 126 are assembled to the top of the frame 102.

As noted above, FIGS. 2A and 2B illustrate the delivery/drop box 100 in the horizontal configuration (100B). The delivery/drop box 100 in the horizontal configuration may include four fixed panels that are assembled around to frame 102. The access door 108 may be located in one side of the box 100B, as shown, or could instead be located in the rear instead of a fixed panel. The hinged front panel 134 and drop door assembly 140 are assembled to the frame 102 in the front of the box 100A. Three floor panels 110, three fixed roof panels 122, and one hinged roof panel 126 complete the box 100B.

It will be appreciated that the panels may be available in different sizes. For example, for a horizontal assembly, instead of three fixed roof panels 122 of the same size, two different size panels may be available with a single, double-length panel replacing two of the standard length panels. Or, a single, triple-length panel may be available. Similarly, side panels 104 may be made available in single or double length. Additionally, sections of the frame 102 may be integrated into the panels instead of being separate components. Many variations are possible and are within the scope of the present invention. For ease of shipping, the panels may be stacked and boxed, then assembled on site.

Figure 3A:
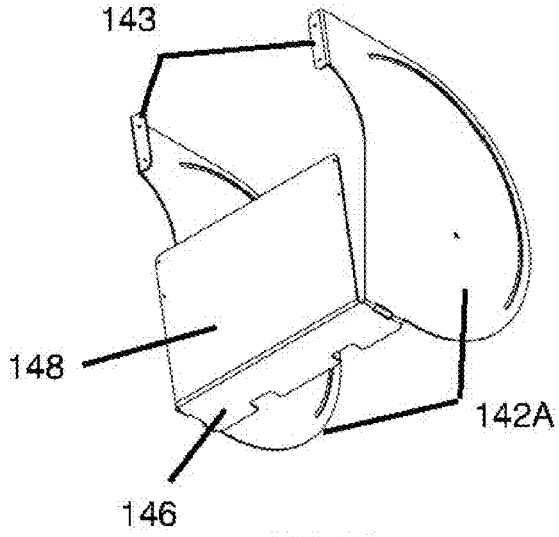
FIG. 3A illustrates a front perspective view of the drop slot mechanism of FIGS. 1A and 2A.
Figure 3B:
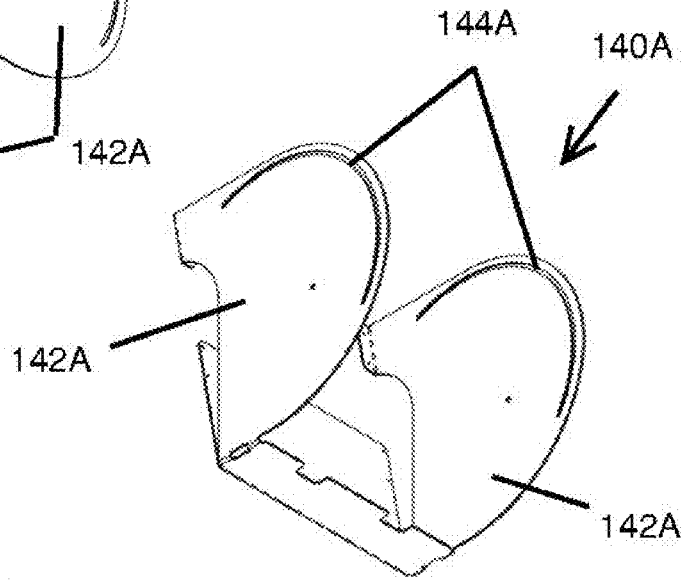
FIG. 3B illustrates a rear perspective view of the drop slot mechanism of FIGS. 1A and 2A.
Figure 3C:
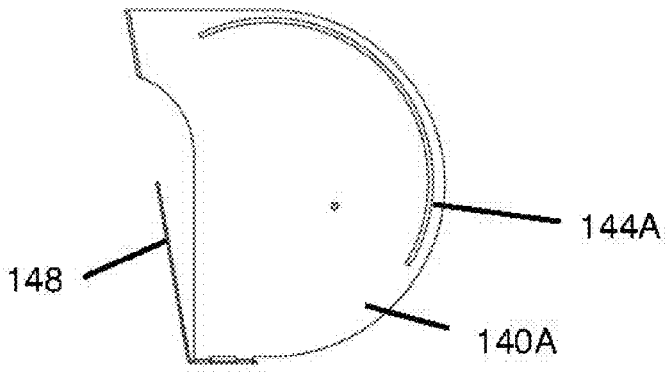
FIG. 3C illustrates a side view of the drop slot mechanism of FIGS. 1A and 2A.

FIGS. 3A-3C are close-up views of one embodiment of the drop door assembly 140A. The assembly 140A, which forms a bin for parcels, products, and other items before they drop into the interior of the box 100, includes a pair of semi-circular side plates 142A having flanges 143 at their upper ends and are connected at their lower ends with a bottom plate 146. A rear plate 148 is connected across the bottom plate 146, covering the lower portion of the space between the side plates 142A. The hinged door panel 134 (not shown in FIGS. 3A-3C) is secured to the flanges 143 and the bottom plate 146; the door panel 134 is also connected at its lower corners by a hinge to the frame 102.

Both side plates 142A have an arcuate (constant radius) slot 144A formed along their inner curved edge. A pair of roof lift arms 128 (shown in FIGS. 4A-4F), secured at their upper ends to the underside of the hinged roof section 126, have tabs or pins 128A at their lower ends that ride in the arcuate slots 144A. The side plates 142A and roof lift arms 128 act as eccentric cams and cam followers such that, when the front panel 134 is opened about $1/4^{th}$ of the way, the drop door assembly 140A rotates about the hinge and the roof lift arms 128, sliding in the arcuate slots 144A, push the hinged roof section 126 upwards, forming a larger opening than is possible when the hinged front panel 134 is only part-way opened to accept larger packages/products. The length of the lift arms 128 affects how far the hinged roof section 126 will be raised and, therefore, how large an item can be inserted through the resulting opening into the box 100. When lift arms 128 of multiple lengths are provided or offered, the end user may decide his or her own tradeoff between smaller opening/ higher security and larger opening/lower security.

Figure 4A:
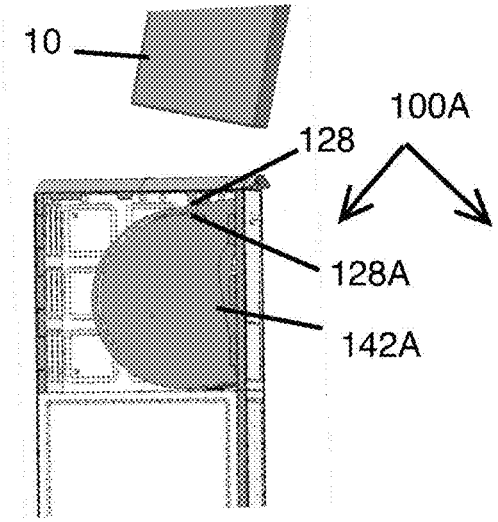
FIGS. 4A-4F sequentially illustrate the operation of the delivery/drop box of FIGS. 1A and 2A
Figure 4B:
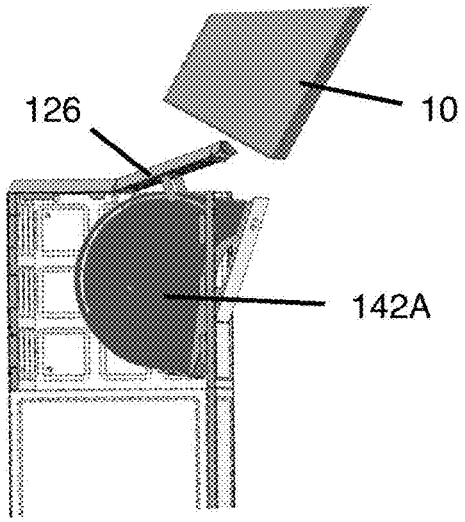
Figure 4C:
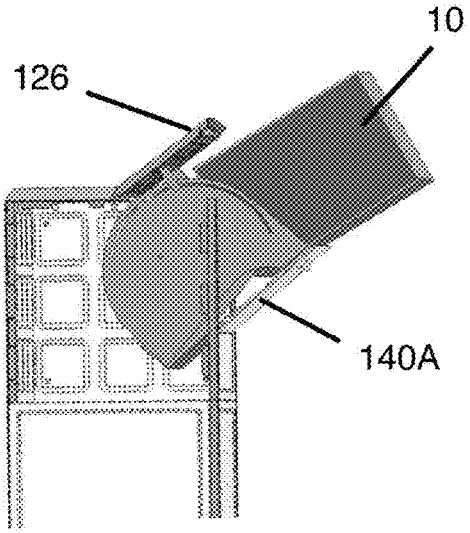
Figure 4D:
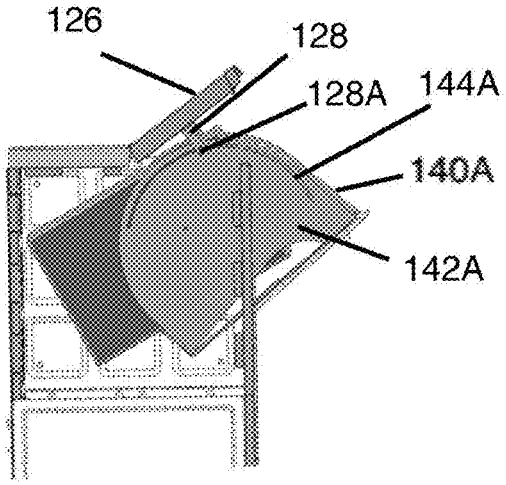
Figures 4E, 4F:
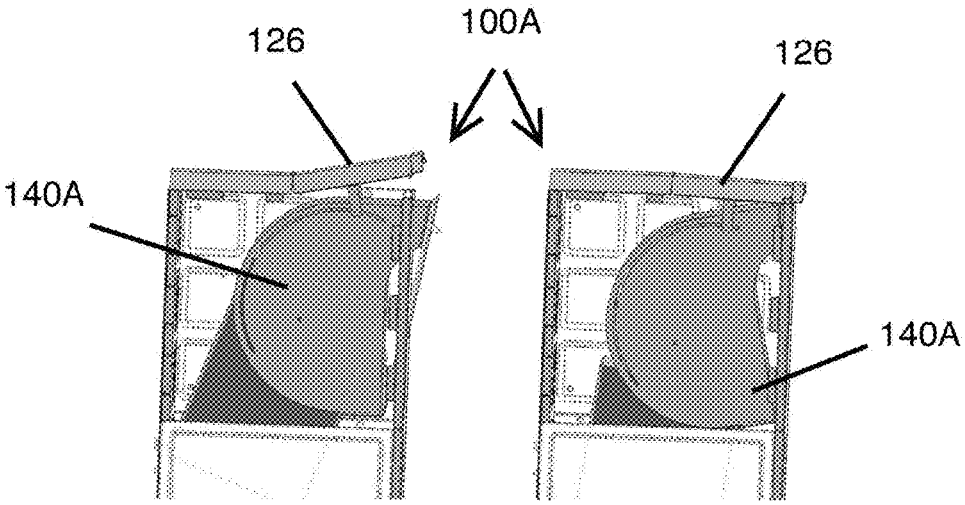

FIGS. 4A-4F sequentially illustrate the operation of the drop door assembly 140A. In FIG. 4A, a parcel 10 arrives to be delivered. In FIG. 4B, the hinged front panel 134 is pulled opened and the hinged roof section 126 begins to rise as the roof lift bars 128 follow the arcuate slots 144A in the side plates 142A. In FIG. 4C, the front panel 134 and hinged roof section 126 have created a large enough opening to allow the parcel 10 to be slid into the delivery/drop box 100 (FIG. 4D). In FIG. 4E, the parcel 10 is inside the delivery/drop box 100 and the front panel 134 is being closed, lowering the hinged roof section 126. In FIG. 4F, the parcel 10 drops into the interior of the delivery/drop box 100 and the front panel 134 and hinged roof section 126 are fully closed. The recipient may retrieve the parcel 10 at his or her convenience by unlocking and opening the access door 108.

Figure 5:
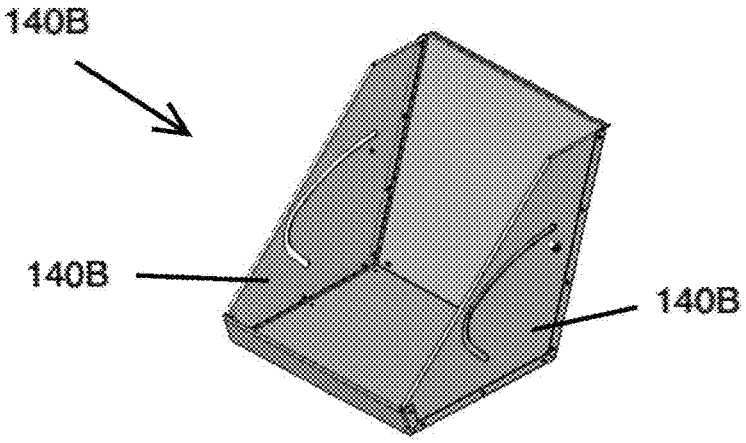
FIG. 5 illustrates another embodiment of a drop ramp which may be incorporated into the delivery/drop box of the present invention.
Figure 6A:
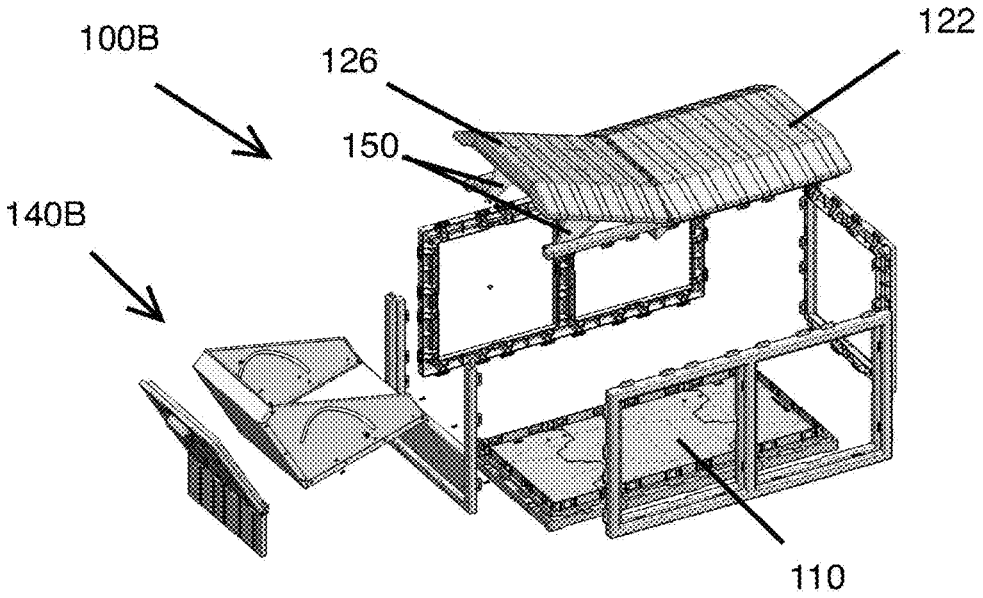
FIG. 6A illustrates an exploded view of a delivery/drop box with the drop ramp of FIG. 5.
Figure 6B:
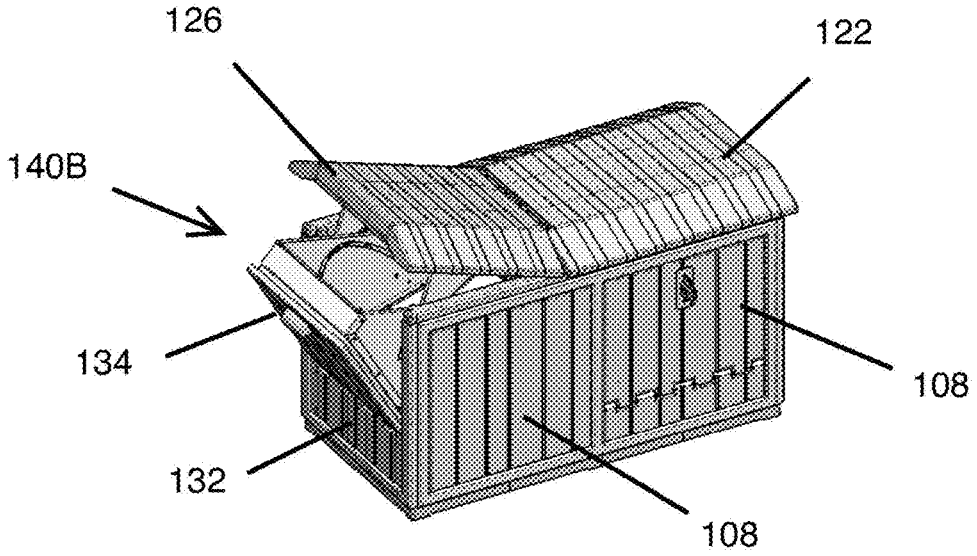
FIG. 6B illustrates the assembled secure delivery/drop box of FIG. 6A with the drop door and roof hatch open.
Figure 7A:
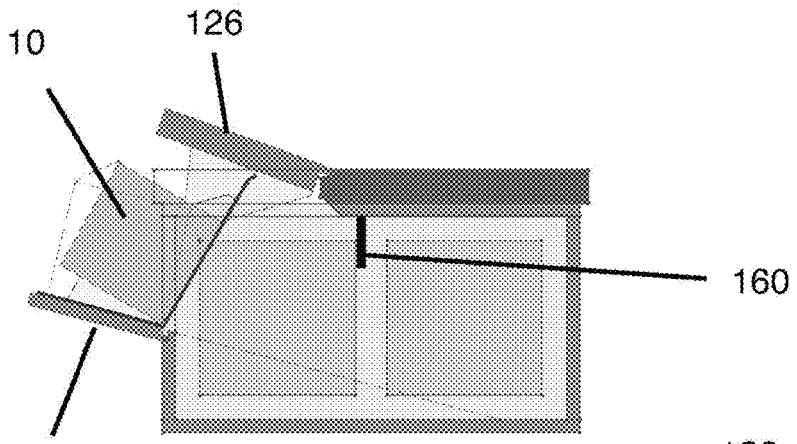
FIGS. 7A-7C are side views of the delivery/drop box using the drop ramp of FIG. 5, sequentially illustrating a parcel being deposited in the box.
Figure 7B:
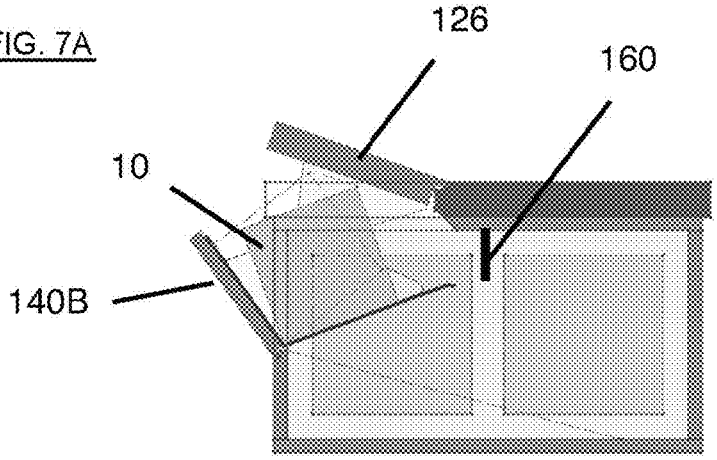
Figure 7C:
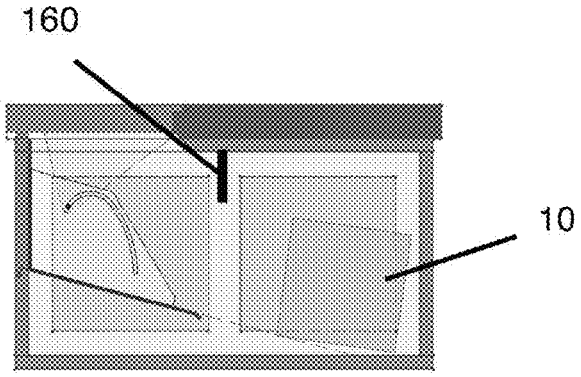

FIG. 5 illustrates another embodiment of a drop door assembly 140B which may be incorporated into the delivery/drop box 100 of the present invention. The slots 144B in the side plates 142B, rather than being arcuate as in the embodiment illustrated in FIGS. 3A-3C and 4A-4F, have a variable radius curve variable cam slot In this configuration, the drop door assembly 140B rotates on a pair of hinge pins and the slots 144B act as cams for triangular lift plates 150 (FIG. 6A) that are attached along one edge to the underside of the hinged roof panel 126 and are engaged at an opposite corner in the slots 144B. Opening the hinged front door or panel 134 causes the lift plates 150 to raise the hinged roof panel 126; closing the door 134 lowers the roof panel 126. FIG. 6A illustrates an exploded view of a delivery/drop box, in the horizontal configuration 100B, with the drop door assembly 140B of FIG. 5, but without the side and rear panels 104, 106, and FIG. 6B illustrates the assembled secure delivery/drop box 100B of FIG. 6A, with the drop door assembly 140B and roof hatch 126 open. FIGS. 7A-7C are side views of the secure delivery/drop box 100B of FIGS. 6A and 6B, sequentially illustrating a parcel being deposited in the box 100B.

Figure 8A:
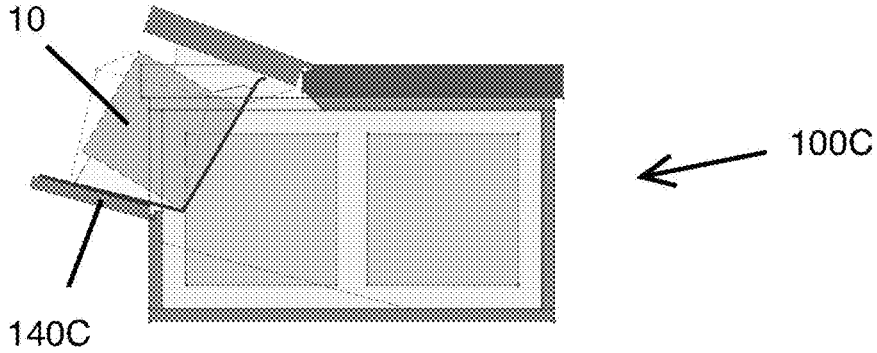
FIGS. 8A-8C are side views of another embodiment of the secure delivery/drop box using a variation of the drop ramp of FIG. 5, with the side panel removed, the side views sequentially illustrating a parcel being deposited in the box.
Figure 8B:
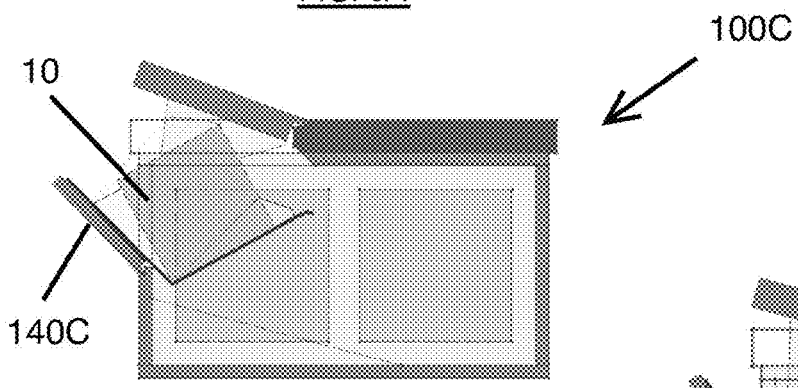
Figure 8C:
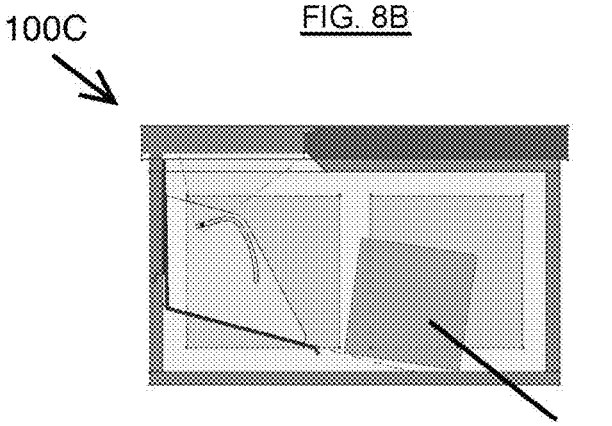

FIG. 8A-8C are side views of another embodiment of the secure delivery/drop box 100C of the present invention in the horizontal configuration, as viewed through the side panel, sequentially illustrating a parcel 10 being deposited in the box. The embodiment of FIGS. 8A-8C incorporates a variation 140C of the drop door assembly 140B of FIG. 5.

Although the drop door assembly 140 may be the same in the horizontal configuration as it is in the vertical configuration, alternatively, a longer bottom plate may be provided for the horizontal configuration than for the vertical configuration, thereby reducing the risk of someone reaching through the opening and pulling a parcel out of the box 100. In addition, the box 100 may be provided with an optional baffle 160 attached to the underside of the fixed roof panel 126, such as near the front edge of the fixed roof panel 126, and extending across the width of the box 100 (FIGS. 7A-7C). The presence of the baffle 160 may provide additional security by preventing someone from reaching very far through the opening.

Figure 9:
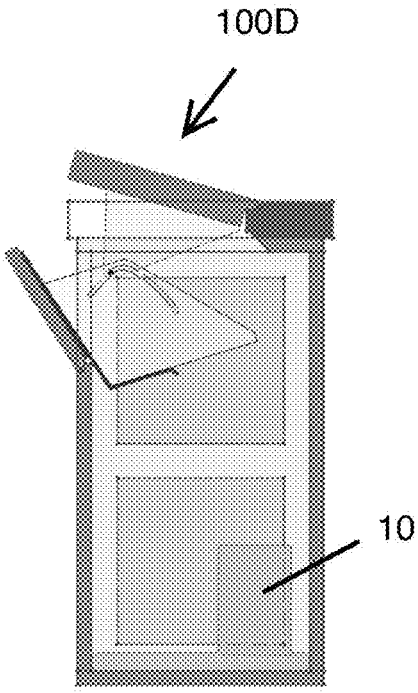
FIG. 9 is a side view of an embodiment of the secure delivery/drop box of FIGS. 8A-8C in the vertical configuration, with the side panel removed and a parcel having been deposited in the box.

FIG. 9 is a side view of the delivery/drop box of FIGS. 8A-8C in the vertical configuration 100D, as viewed through the side panel, and a parcel 10 having been deposited in the box.

As previously noted, the delivery/drop box 100 may be provided in a number of convenient sizes, with dimensions sufficient to provide enough interior volume for one or more parcels of various sizes. For example, several side and floor panels 104, 110 may be connected in different configurations, allowing the delivery/drop box 100 to have dimensions that are multiples of each panel, depending on the sizes of the parcels that are expected to be delivered. The side panels 104, floor panel(s) 110, roof panels 122, drop door assembly 140, and other components may be of any appropriate material. High-density polyethylene (HDPE) is one material that is light in weight but weatherproof and sufficiently strong to be a theft deterrent.

The delivery/drop box of the present invention provides an affordable and light weight, yet secure, receptacle for packages and parcels of a variety of shapes and sizes without requiring a large amount of space. As described above, the box may be provided in a kit form and assembled in either a horizontal or vertical configuration. Use of the box reduces the risk of theft and weather damage. Use of the box also reduces the need to redirect scheduled deliveries or adjust one's own schedule in order to be present for a delivery.

The description of the present invention has been presented for purposes of illustration and description, but is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

What is claimed is:

1. A delivery/drop box for parcels and products, comprising:
- a frame;
- a plurality of wall panels securable to the frame;
- a floor panel securable to the frame;
- a fixed roof section securable to the frame;
- a cam roof section hingeably securable to at least one of the frame and the fixed roof section;
- a fixed front panel securable to the frame;
- a drop door assembly hingeably securable to at least one of the frame and the fixed front panel whereby, as the drop door assembly is moved to an open position, the cam roof section moves to a raised position and an opening into an interior of the box is created; and
- a lockable door panel hingeably securable to one of the side or rear panels, whereby an item passed through the opening into the interior of the box is accessible when the door panel is unlocked and open and is inaccessible when the door panel is closed and locked.

2. The delivery/drop box of claim 1, the drop door assembly comprising:
- a pair of semi-circular side plates having flanges at upper ends;
- a bottom plate connected between the pair of side plates;
- a rear plate connected between the pair of side plates;
- a front panel secured to the flanges and the rear plate and hingedly connected at lower corners to the frame;
- whereby the pair of side plates, the bottom plate, and the rear plate form a bin to receive items to be passed into the interior of the box.

3. The delivery/drop box of claim 2, whereby both side plates have an arcuate slot formed therethrough, the drop door assembly further comprising a pair of lift arms each pivotally secured at one end to an underside of the cam roof section and having a pin at an opposite end engaged in the arcuate slot, whereby, when the drop door assembly is moved to the open position, the pins of the lift arms ride in the arcuate slots and raise the cam roof section.

4. The delivery/drop box of claim 3, wherein the distance that the cam roof section is raised is dependent upon the length of each of the lift arms.

5. The delivery/drop box of claim 2, whereby both side plates each have a variable radius curve slot formed therethrough, the drop door assembly further comprising a pair of lift plates each secured along one edge to an underside of the cam roof section and each having a pin at an opposite corner engaged in the variable radius curve slot, whereby, when the drop door assembly is moved to an-the open position, the pins of the lift plates ride in the variable radius curve slots and raise the cam roof section.

6. The delivery/drop box of claim 1, further comprising a baffle extending downward from an underside of the fixed roof section.

7. The delivery/drop box of claim 1, whereby the lockable door panel is assembled in a rear of the delivery/drop box.

8. The delivery/drop box of claim 1, whereby the lockable door panel is assembled in a side of the delivery/drop box.

9. The delivery/drop box of claim 1, whereby the delivery/drop box is assembled in a vertical orientation.

10. The delivery/drop box of claim 1, whereby the delivery/drop box is assembled in a horizontal orientation.

11. The delivery/drop box of claim 1, whereby the plurality of wall panels, the floor panel, and the fixed roof section are formed from a high-density polyethylene (HDPE) material.

12. The delivery/drop box of claim 1, whereby the plurality of wall panels, the floor panel, and the fixed roof section snap together.

* * * * *